US008333413B2

(12) United States Patent
Bourgoin et al.

(10) Patent No.: US 8,333,413 B2
(45) Date of Patent: Dec. 18, 2012

(54) AUTOMATIC SASH LOCK WITH ROTARY LATCH

(75) Inventors: Brian Bourgoin, East Haddam, CT (US); Jeffrey M. Briggs, Madison, CT (US)

(73) Assignee: Roto Frank of America, Inc., Chester, CT (US)

( * ) Notice: Subject to any disclaimer, the term of this patent is extended or adjusted under 35 U.S.C. 154(b) by 182 days.

(21) Appl. No.: 12/706,072

(22) Filed: Feb. 16, 2010

(65) Prior Publication Data

US 2010/0207403 A1 Aug. 19, 2010

Related U.S. Application Data

(60) Provisional application No. 61/153,739, filed on Feb. 19, 2009.

(51) Int. Cl.

| | |
|---|---|
| ***E05C 1/12*** | (2006.01) |
| ***E05C 1/02*** | (2006.01) |
| ***E05C 1/06*** | (2006.01) |
| ***E05C 3/16*** | (2006.01) |
| ***E05B 63/20*** | (2006.01) |

(52) U.S. Cl. ..... 292/164; 292/137; 292/140; 292/225; 292/332

(58) Field of Classification Search ..... 292/137, 292/162, 163, 335, 4, 332, 333, 334, 336, 292/DIG. 20, DIG. 47, 165, 169, 169.14, 292/172, 140, 142, 145, 146, 150, 80, 84, 292/225, 235, DIG. 16, DIG. 57, DIG. 61, 292/DIG. 31; 49/449

See application file for complete search history.

(56) References Cited

U.S. PATENT DOCUMENTS

| | | | | |
|---|---|---|---|---|
| 1,302,873 | A | 5/1919 | Stiff | |
| 5,301,989 | A * | 4/1994 | Dallmann et al. | 292/142 |
| 5,318,333 | A * | 6/1994 | Dreifert | 292/336.3 |
| 6,022,056 | A * | 2/2000 | Cope et al. | 292/144 |
| 6,651,389 | B2 | 11/2003 | Minter et al. | |
| 6,682,109 | B2 * | 1/2004 | Horne et al. | 292/22 |
| 6,733,049 | B2 * | 5/2004 | Piorkowski et al. | 292/139 |
| 6,848,728 | B2 * | 2/2005 | Rotondi et al. | 292/336 |
| 7,261,342 | B2 * | 8/2007 | Smith | 292/332 |
| 7,407,199 | B2 * | 8/2008 | Richardson | 292/163 |
| 7,540,046 | B1 * | 6/2009 | Lai | 5/100 |
| 7,874,598 | B2 * | 1/2011 | Chung | 292/163 |
| 2008/0012357 | A1 | 1/2008 | Liang et al. | |
| 2008/0179896 | A1 * | 7/2008 | Chung | 292/164 |

* cited by examiner

*Primary Examiner* — Kristina Fulton
*Assistant Examiner* — Nathan Cumar
(74) *Attorney, Agent, or Firm* — Miller, Matthias & Hull LLP

(57) ABSTRACT

A latch for a window sash is disclosed. The latch includes a cover with a handle, a chassis, a bolt biased towards an extended position and containing a notch, a plunger biased towards the extended position and containing a guide, a rotary latch, pivotally connected to the chassis, containing a guide slot for receiving the guide and a protrusion biased towards the notch. The latch is operated wherein the bolt is locked in a retracted position when the handle slides the bolt inwardly towards the chassis and the protrusion engages the notch as the rotary latch rotates towards the notch, and wherein the bolt is released to the extended position when the plunger slides inwardly towards the chassis and the protrusion disengages from the notch as the rotary latch rotates away from the notch.

17 Claims, 11 Drawing Sheets

AUTOMATIC SASH LOCK WITH ROTARY LATCH

CROSS-REFERENCE TO RELATED APPLICATION

This application claims priority under 35 U.S.C. 119(e) to U.S. Provisional Patent Application No. 61/153,739 filed on Feb. 19, 2009, the disclosure of which is incorporated by reference in its entirety.

FIELD OF THE DISCLOSURE

This disclosure generally relates to latches and, in particular, relates to an automatic rotary latch for sliding or hung window sashes.

BACKGROUND OF THE DISCLOSURE

Existing hung and slider windows utilize various means for locking the primary movable sash to the fixed or secondary sliding sash. Traditionally, latches are utilized to lock window sashes. The window sashes are locked when a latch is engaged with a striker. To unlock the window, an operating lever is used to pull the latch or pivot the latch to a retracted position, clearing the latch from the striker. Once the latch is cleared from the striker, the window is slid open. To lock the window, the operating lever is used to push or pivot the latch to a locked position, where the latch engages the striker. Currently there exists a number of self-latching window sash locks available on the market. Self-latching locks automatically latch the window sashes after the window sashes are closed. Thus when the latch has reached the same level as the striker it latches the window in the closed position automatically. However, to open the window the operating lever still needs to be held in order to allow the latch to clear the striker as the window is slid open. Once the latch clears the striker, the operating lever is released and the latch returns to an extended position or locked position. The action of opening such a window requires the operator to use one hand to unlock the self-latching lock, while simultaneously using the other hand to slide the window. Not only is this action awkward to perform but also it can be very difficult to perform on large windows, windows without finger grips, windows with more than one latch and windows which have limited and restricted access. A need for an automatic sash lock still remains, wherein the operator interfaces with the sash lock once and has both hands available for sliding the window open and shut, while the latch automatically unlatches and latches to the striker.

SUMMARY OF THE DISCLOSURE

An improved latch is disclosed. The latch comprises a chassis that defines a recess. The latch also comprises a bolt that is biased towards an extended position and that is slidably received in the recess. The bolt comprises a passage and a notch. The latch also comprises a plunger that is biased towards an extended position and which is slidably received in the passage. The chassis comprises an opening on which a post of a rotary latch is pivotally mounted. The bolt comprises a notch and the rotary latch comprises a protrusion that is biased towards the notch of the bolt when the bolt is pulled into a retracted position or when the bolt slides inwardly towards the chassis and the protrusion of the rotary latch rotates towards the notch in the bolt. When the bolt is released to the extended position, the plunger slides inwardly towards the chassis and the protrusion of the rotary latch disengages from the notch of the bolt as the rotary latch rotates away from the notch.

In a refinement, a method for operating a latch for a window sash is disclosed. The method comprises biasing the bolt and the plunger towards an extended position. The bolt is slidably received in the recess of the chassis and the plunger is slidably received in a passage of the bolt. The method further comprises unlocking the latch by retracting from the extended position to the retracted position by engaging the notch on the bolt with the protrusion on the rotary latch to hold the bolt in the retracted position. The rotary latch is pivotally connected to the chassis and biased towards the notch. The method further comprises opening the window sash that results in the plunger engaging the striker as the window is opened, thereby retracting the plunger and causing the protrusion on the rotary latch to rotate and disengage from the notch which results in the bolt and the plunger moving back to the extended position upon clearing the striker. The method also comprises closing the window sash so the bolt and the plunger retract upon engaging the striker, before releasing to the extended position upon clearing the striker, and locking the latch.

In another refinement, another improved sash lock is disclosed. The sash lock comprises a chassis that defines a recess and a cover, which is mounted to the chassis. The cover comprises a handle, which is coupled to a bolt. The bolt is accommodated in the recess and is biased towards an extended position. The bolt comprises a passage and a notch. A plunger is biased towards the extended position and slidably received in the passage. The chassis comprises an opening for pivotally mounting a post of a rotary latch to the chassis. The rotary latch comprises a protrusion that is biased towards the notch in the bolt. In a retracted position, the bolt is held inwardly towards the chassis and the protrusion of the rotary latch engages the notch in the bolt. In an extended position, the bolt is released when the plunger slides inwardly towards the chassis and the protrusion disengages from the notch as the rotary latch rotates away from the notch.

Other advantages and features will be apparent from the following detailed description when read in conjunction with the attached drawings.

BRIEF DESCRIPTION OF THE DRAWINGS

For a more complete understanding of the disclosed apparatus and method, reference should be made to the embodiments illustrated in greater detail in the accompanying drawings, wherein.

It should be understood, of course, that this disclosure is not limited to the particular embodiments illustrated herein.

DETAILED DESCRIPTION OF THE DISCLOSURE

Figure 1:
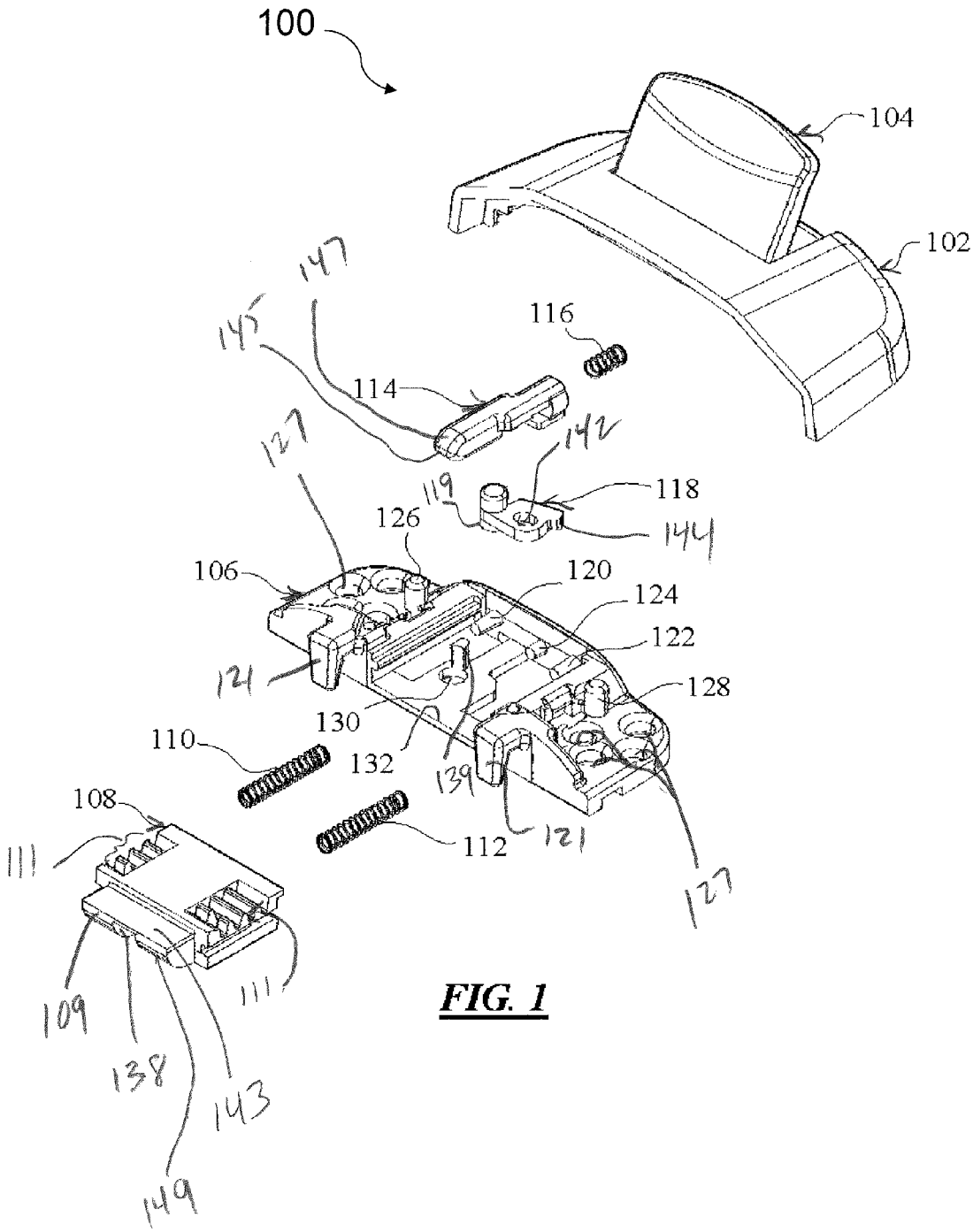
FIG. 1 is an exploded perspective view of one disclosed latch.

Referring to FIG. 1, a latch 100 is illustrated which includes a cover 102 with a trigger or handle 104 as shown in the upper right of FIG. 1. The latch 100 also includes a chassis 106 a latch bolt or bolt 108, bolt springs 110, 112, a plunger 114, a plunger spring 116, and a rotary latch 118. The chassis 106 may have three pins 120, 122, 124 to receive one end of the bolt and plunger springs 110, 112, 116, respectively. The other ends of the bolt and plunger springs 110, 112, 116 are received in openings or slots 113, 115, 117 in the bolt 108 and plunger 114 as shown in FIG. 2*b*. The bolt 108 is slidably received in a recess 132 disposed in the chassis 106. Furthermore, the chassis 106 may have two posts 126, 128 for mounting the cover 102 onto the chassis 106 and a plurality of screw holes 127 for mounting the chassis to a sash (not shown). The chassis 106 also includes a hole or an opening 130 for pivotally receiving a pivot member or post 119 of the rotary latch 118 and a stop 139 that limits the pivotal movement of the rotary latch 118. FIG. 1 also illustrates a pair of downwardly extending pegs 121 used for installing the chassis 106 onto a sash. The bolt 108 as shown in FIG. 1 includes a leading edge 109, a passage 138 for receiving the plunger 114 and a pair of gear racks 111 that enmesh with corresponding arcuate gears 107 disposed on the underside of the handle 104 as illustrated in FIG. 3*a*.

Figure 2A:
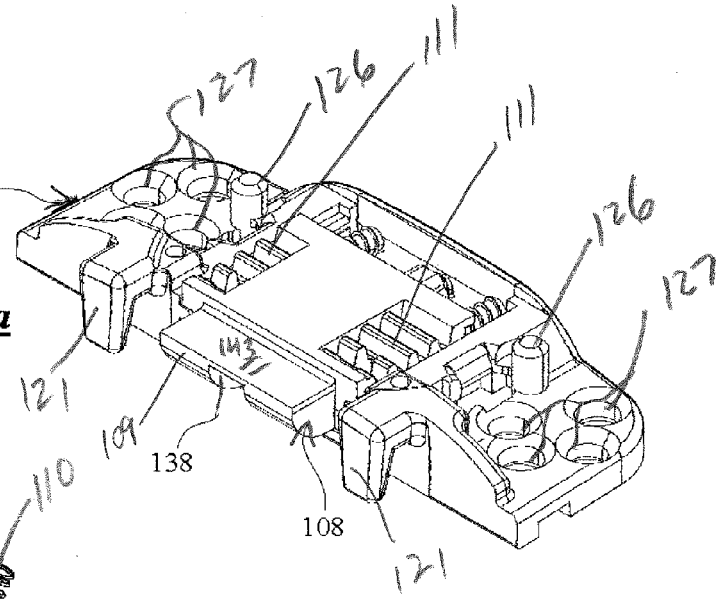
FIGS. 2*a*-2*c* are perspective and bottom views of the latch of FIG. 1 in its extended position.
Figure 2B:
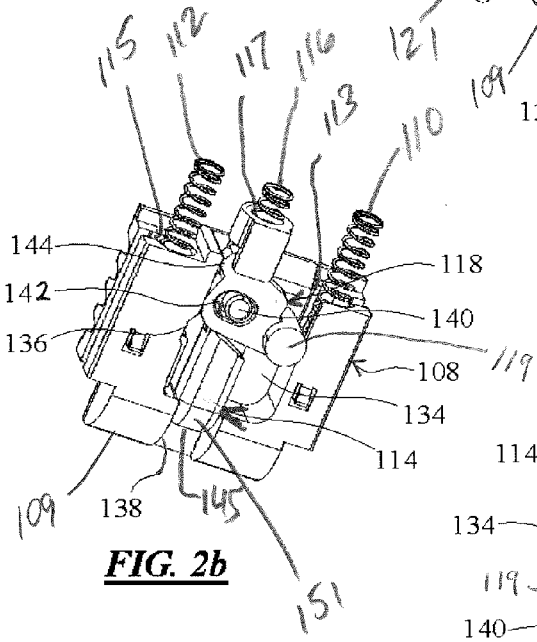

Referring to FIG. 2*a*, the bolts 108 is shown in the extended position with the cover 102 and handle 104 removed. In the extended position, the leading edge 109 of the bolt 108 protrudes beyond the chassis 106. The bottom of the bolt 108, as shown in FIG. 2*b*, includes an interior recess 134 with a notch 136 and a passage 138, which is centrally located on the bolt 108 and through which the plunger 114 can extend. The recess 134 houses the plunger 114 and rotary latch 118. The plunger 114 includes a guide 140 which is received in a guide slot 142 on the rotary latch 118. In one exemplary embodiment, the guide 140 is a downwardly extending pin or post, wherein once inserted in the guide slot 142, may create two degrees of freedom. In addition, the plunger 114 is slidably received by the passage 138, allowing for a more stable and smooth movement of both the plunger 114 and bolt 108. The rotary latch 118 further comprises a protrusion 144 which is received by and is biased towards the notch 136 on the bolt 108 by the action of the plunger spring 116.

Figure 3A:
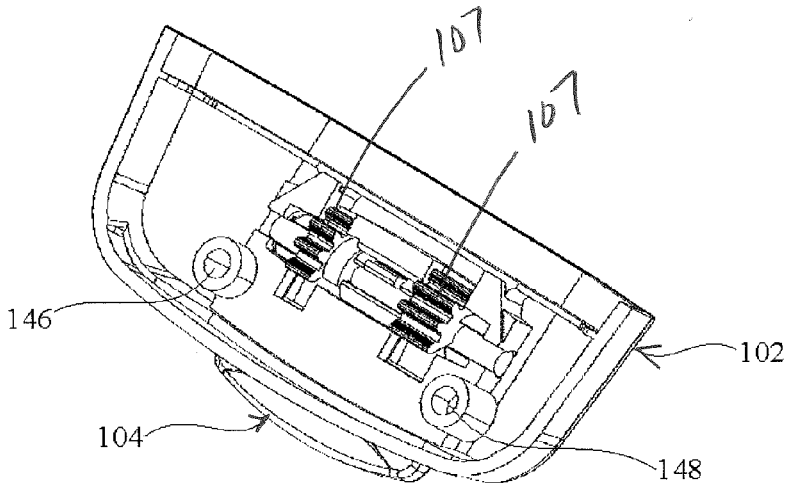
FIGS. 3*a*-3*f* are perspective views of various disclosed covers and handles or triggers.
Figure 3B:
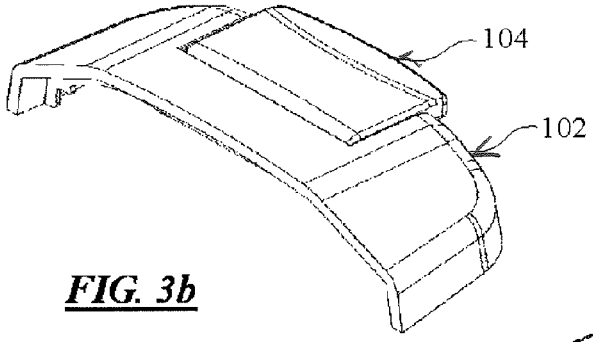
Figure 3C:
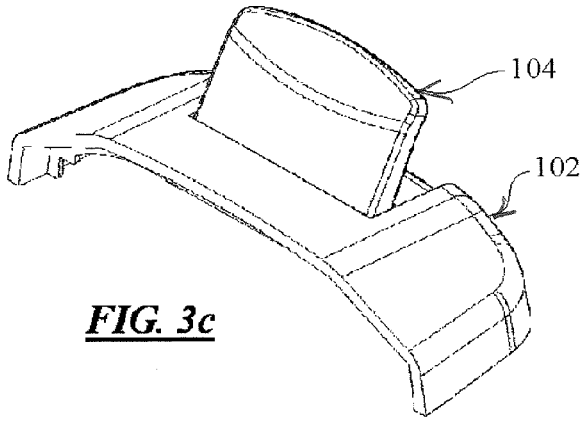
Figure 3D:
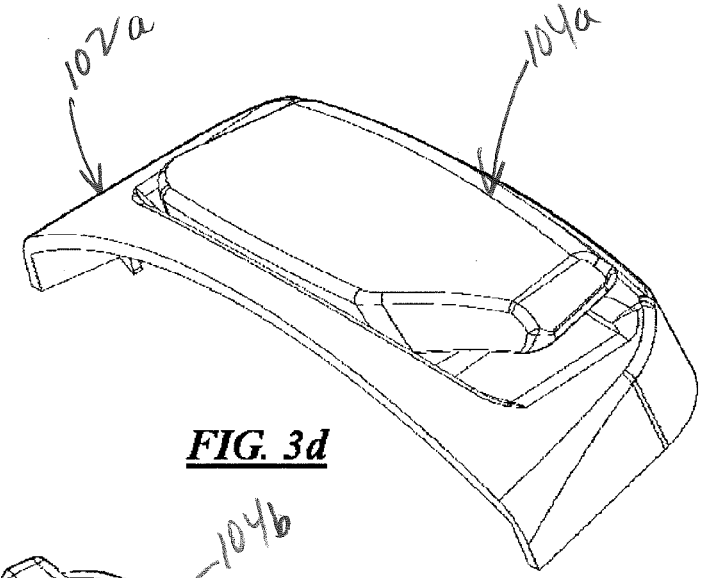
Figure 3E:
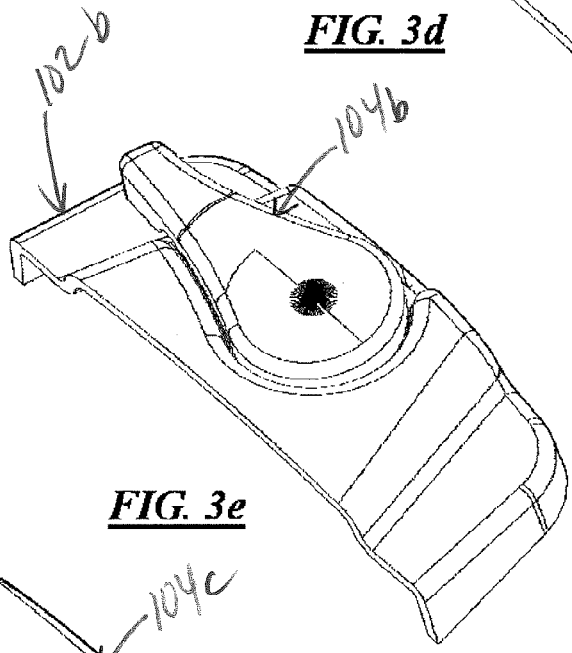
Figure 3F:
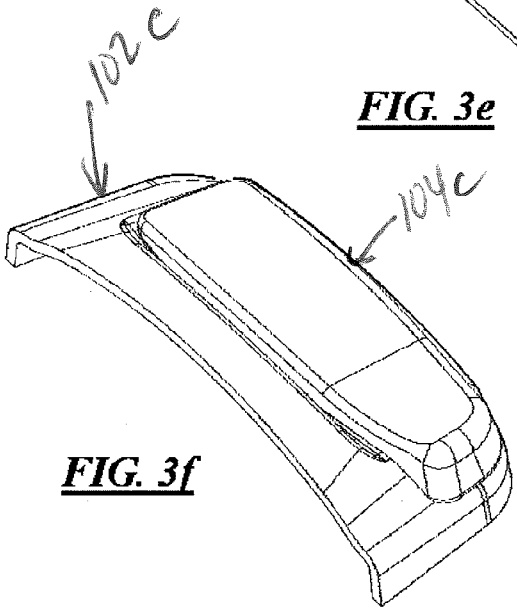
Figure 4A:
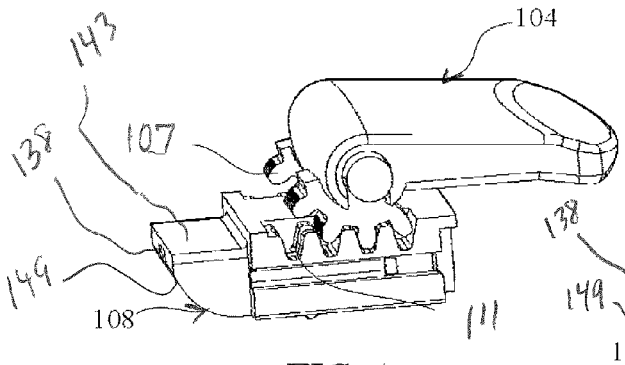
FIGS. 4*a*-4*e* are perspective views of the disclosed handle and bolt illustrating the use of gears on the handle (or trigger) that enmesh with gears on the bolt.
Figure 4B:
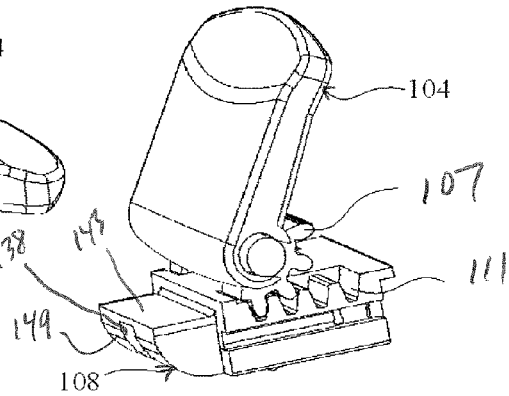
Figure 4C:
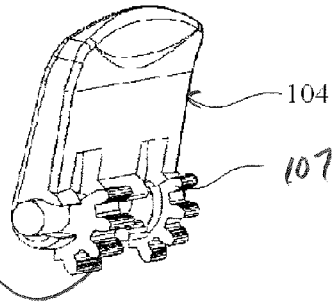
Figure 4D:
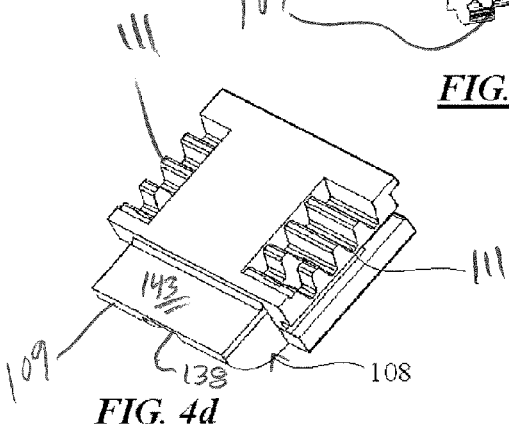
Figure 4E:
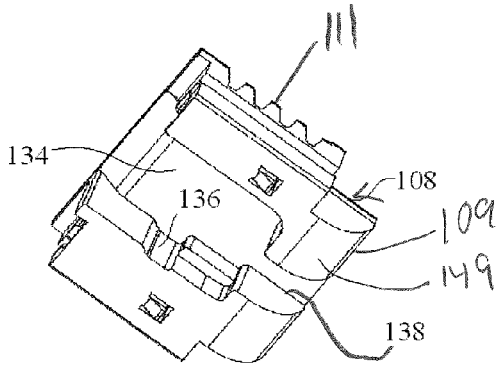

In FIGS. 3*a*-3*c*, the cover 102 and handle 104 are illustrated. The cover 102 may have two post holes 146 and 148 for receiving the posts 126, 128, respectively. The handle 104 is operated for locking and unlocking the latch 100. The arcuate gear sets 107 that are coupled to or form a part of the handle 104, mesh with the gear racks 111 disposed on the bolt 108. Pivotal movement of the handle 104 results in a retraction or extension of the bolt 108. In one exemplary embodiment, when the handle 104 is retracted towards the cover 102, as depicted in FIG. 3*b*, the latch 100 is locked, i.e. the window sash is locked. When the handle 104 is extended away from the cover 102, as depicted in FIG. 3*c*, the latch 100 is unlocked, i.e. window sash is unlocked. Furthermore, it is to be understood that other cover and handle embodiments capable of retracting and extending a bolt are possible to one skilled in the art such as, but not limited to, the covers 102*a*, 102*b*, 102*c* and handles 104*a*, 104*b*, 104*c* depicted in FIGS. 3*d*-3*f*.

Figure 2C:
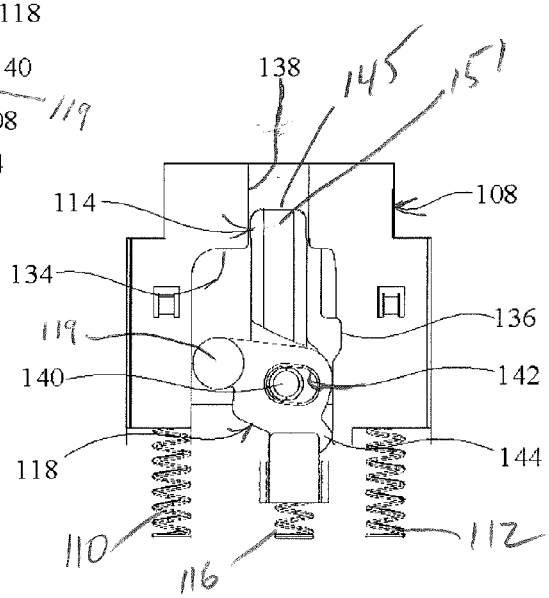

In FIGS. 4*a*-4*e*, the handle 104 is illustrated with a pair of parallel arcuate gears 107 to retract the bolt 108 inwardly towards the chassis 106. The top of the bolt 108 includes gear racks 111 for meshing with the arcuate gears 107. It is to be understood that other means of retracting a bolt with a handle, besides gears and gear racks, are possible to one skilled in the art. As the handle 104 extends away from the cover 102, the bolt 108 is retracted inwardly towards the chassis 106 until the rotary latch 118 latches the bolt 108 to a locked position when the protrusion 144 is received in the notch 136 (compare FIGS. 2*c* and 5*b*).

Figures 5A, 5B, 5C:
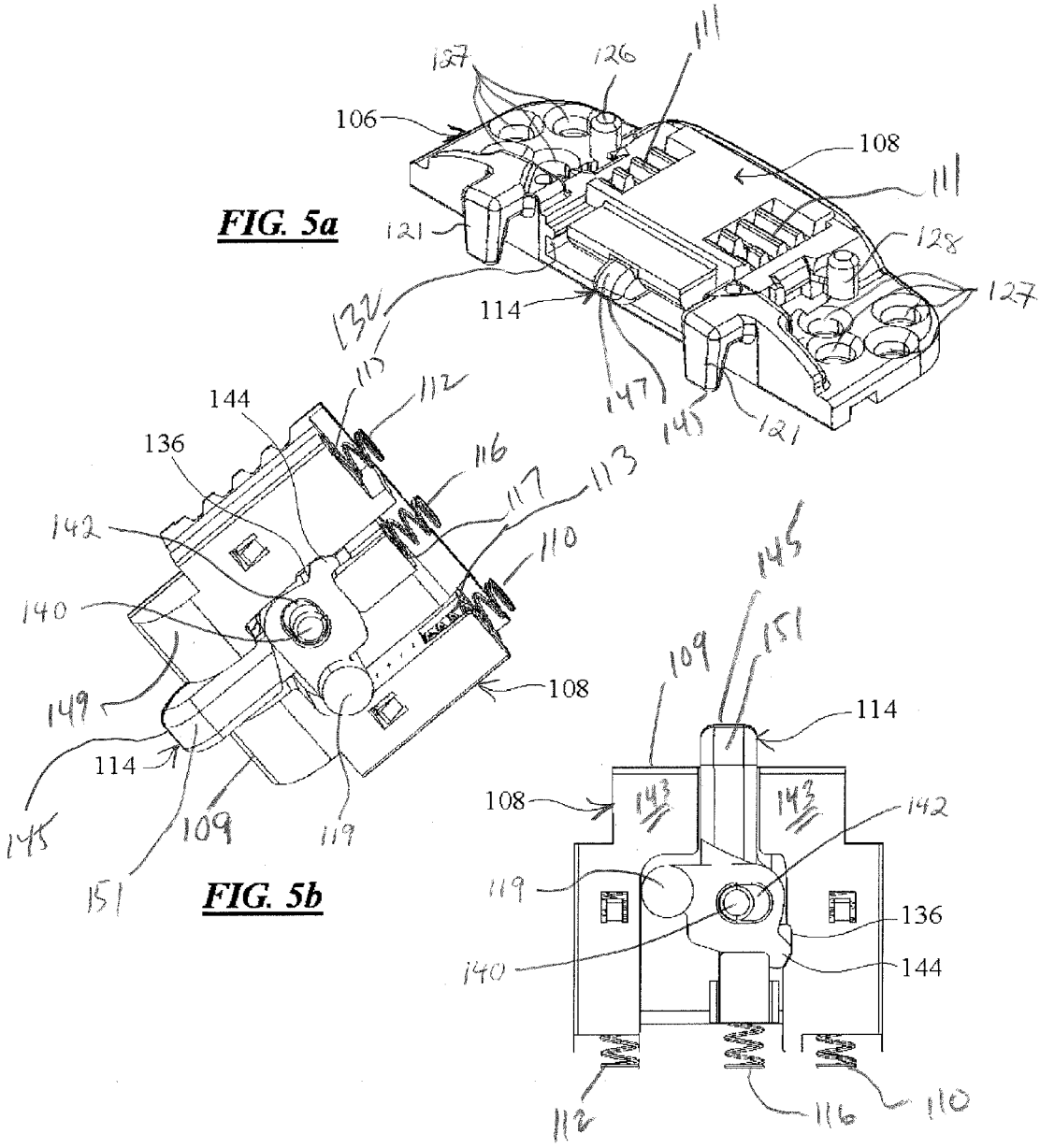
FIG. 5*a* is a top perspective view of the chassis and bolt shown in FIGS. 1*a*-3*a* in the retracted position and FIGS. 5*b*-5*c* are a bottom perspective view and a bottom plan view respectively of the bolt and plunger shown in FIGS. 1 and 2*b*-2*c* with the plunger in the extended position.
Figure 6A:
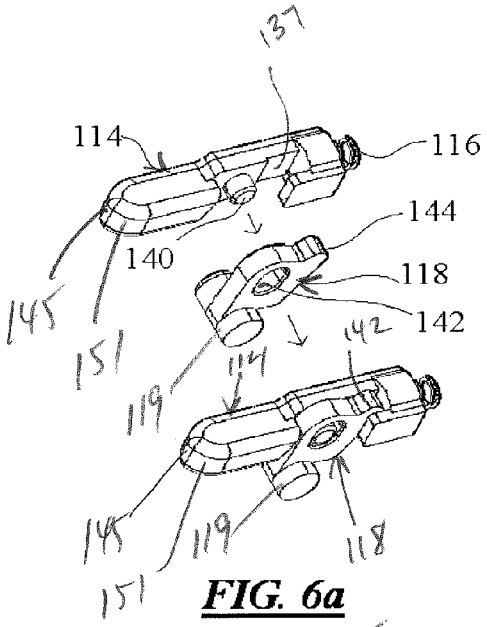
FIGS. 6*a*-6*d* are exploded perspective, top and bottom views the plunger, rotary latch and plunger spring as shown in FIGS. 1, 2*b*-2*c* and 5*b*-5*c;*
Figure 6B:
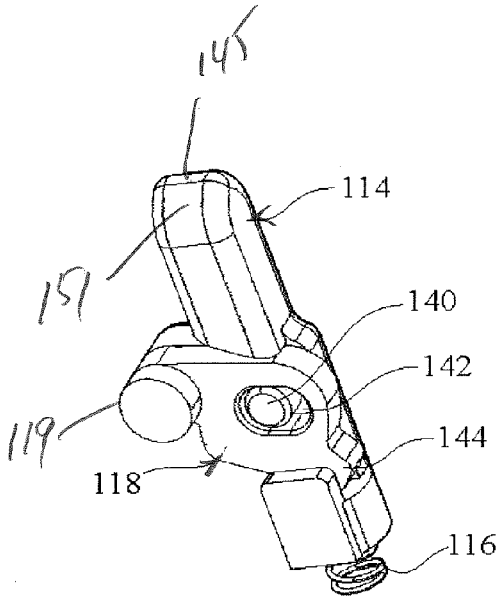
Figure 6C:
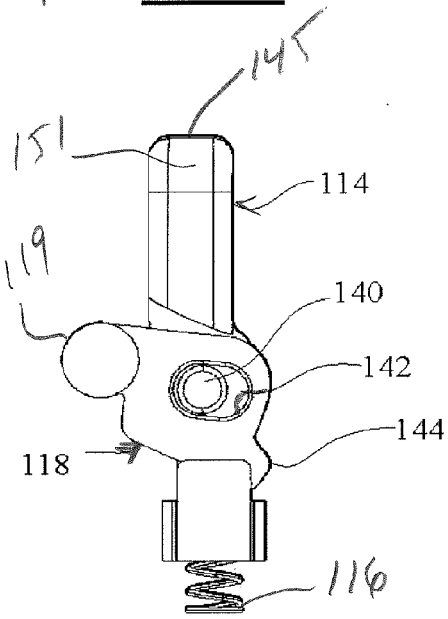
Figure 6D:
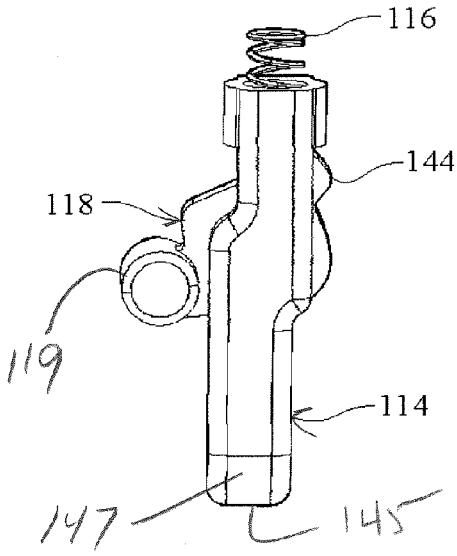
Figure 7:
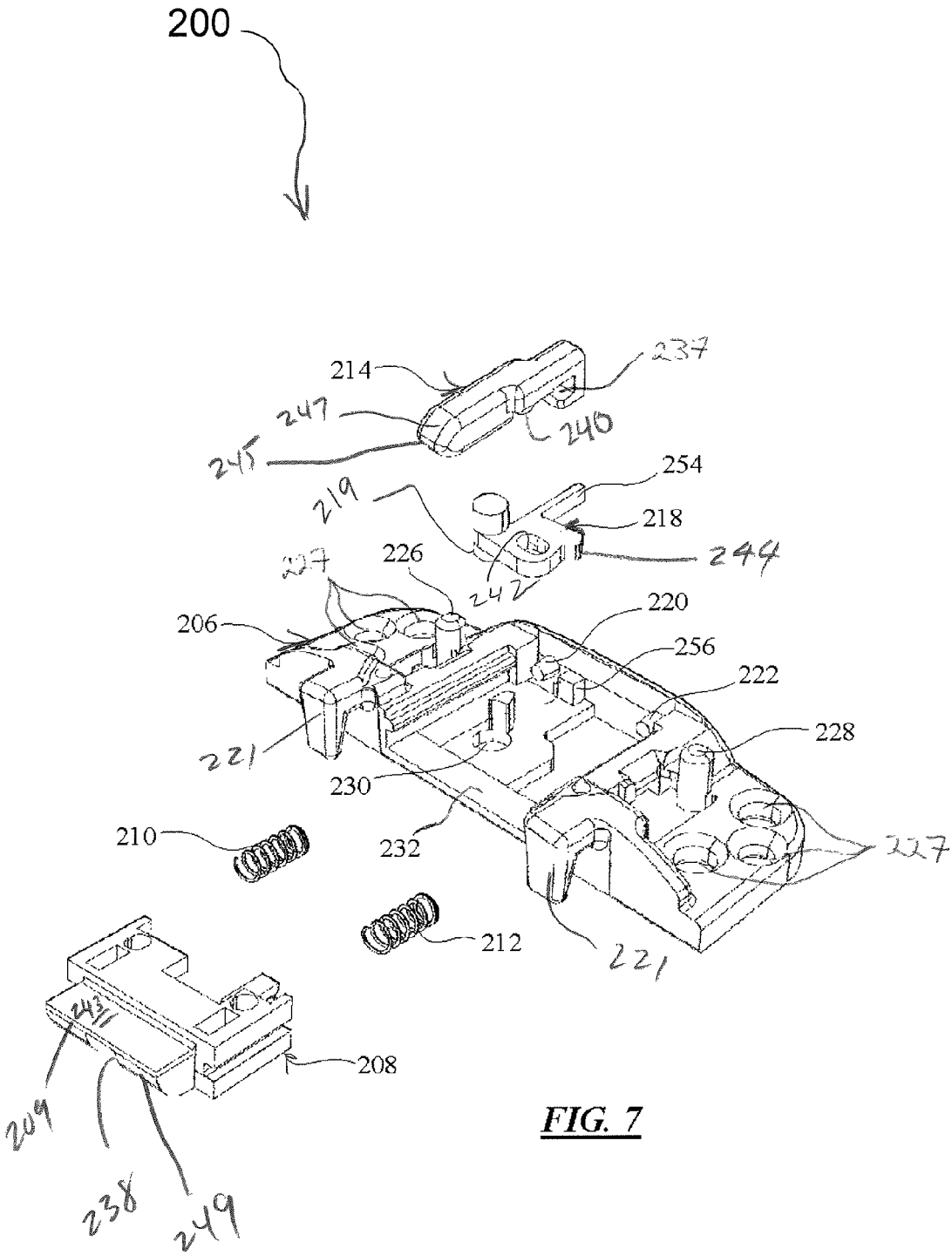
FIG. 7 is an exploded perspective view of another disclosed latch.
Figure 8A:
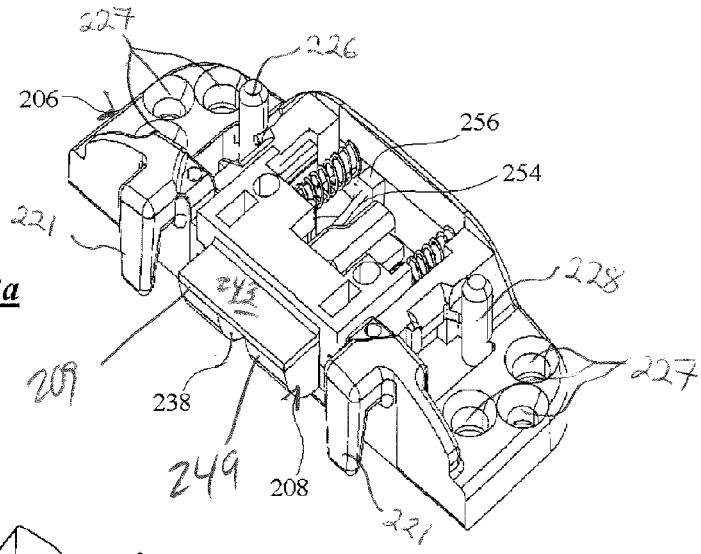
FIGS. 8*a*- 8*c* are perspective and bottom plan views of the latch shown in FIG. 7.
Figure 8B:
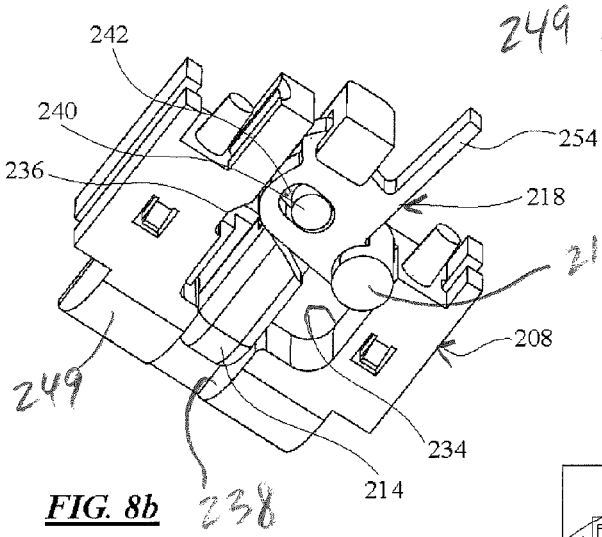
Figure 8C:
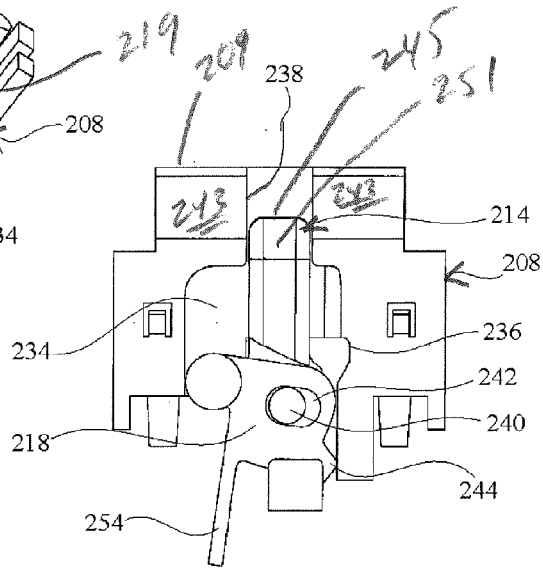
Figure 9A:
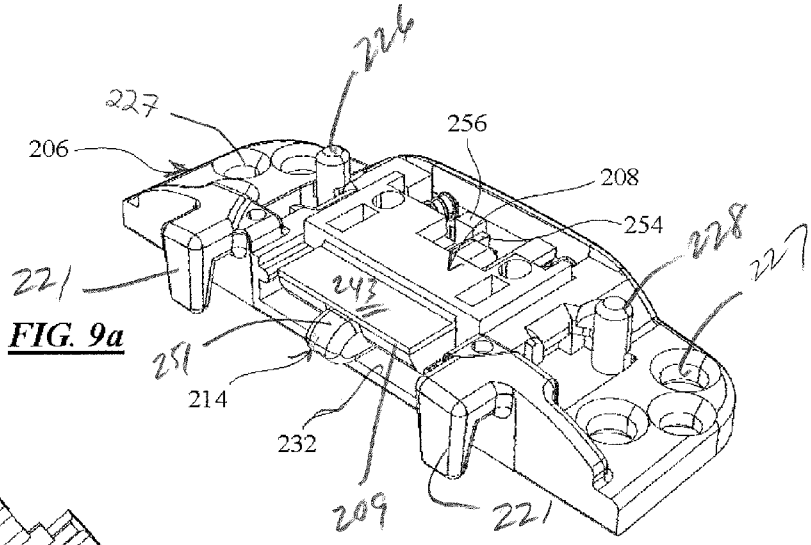
FIGS. 9*a*-9*c* are perspective and bottom views of the chassis, bolt and plunger shown in FIGS. 7-8*c;*
Figure 9B:
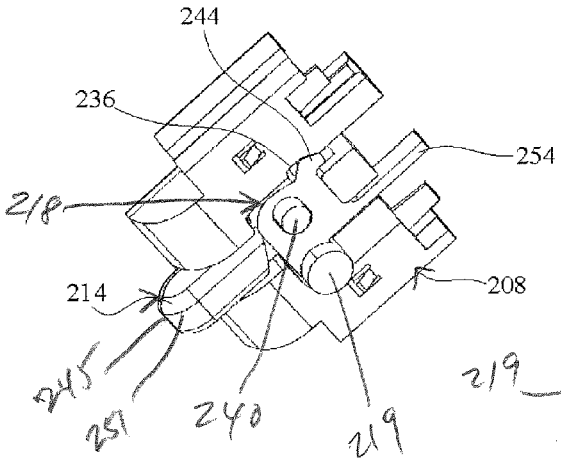
Figure 9C:
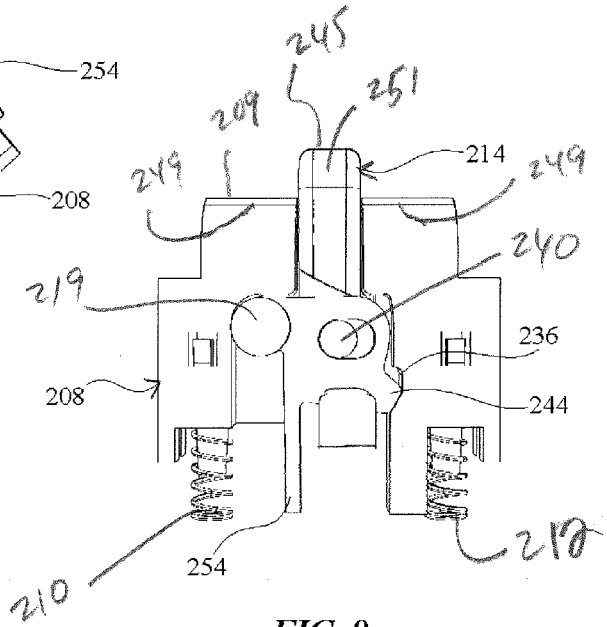
Figure 10A:
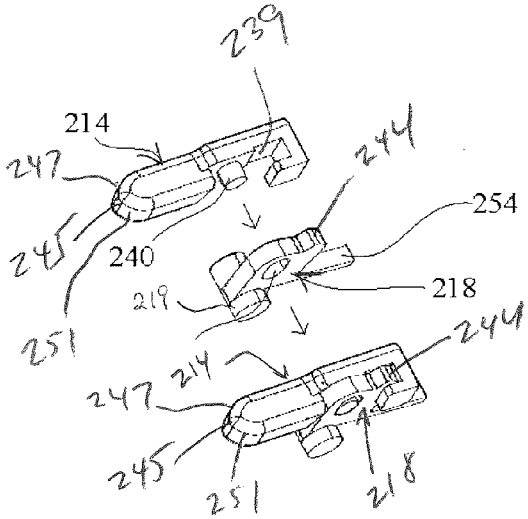
FIGS. 10*a*-10*d* are exploded perspective, top and bottom plan views of the plunger and rotary latch of the embodiment of FIGS. 7-9*c* and their engagement with each other.
Figure 10B:
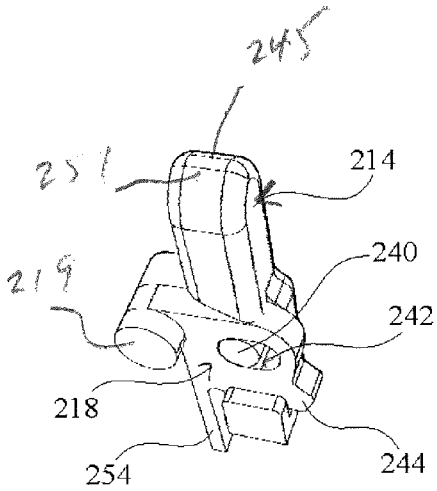
Figure 10C:
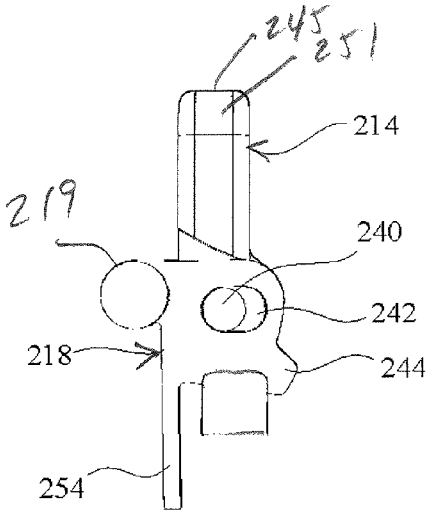
Figure 10D:
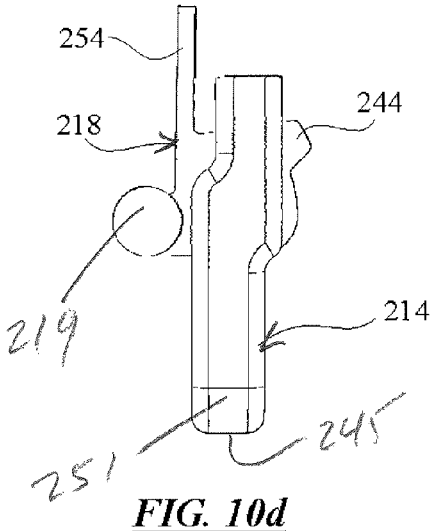

In FIGS. 5*a*-5*c*, the latch 100 is shown in the retracted position. In the retracted position, the bolt 108 is latched in the locked position within the confines of the recess 132 of the chassis 106, while the plunger 114 may remain protruding beyond the chassis 106. As the bolt 108 retracts inwardly towards the chassis 106, the rotary latch 118 rotates towards the notch 136, wherein the protrusion 144 of the rotary latch 118 engages the notch 136 of the bolt 108, locking the bolt 108 in the retracted position.

Once the handle 104 unlatches the bolt 108 from the striker by locking the bolt 108 in the retracted position as shown in FIG. 5*a*, the operator may use both hands to open the window. As the window is slid open, the plunger 114 engages the striker and retracts inwardly towards the chassis 106. The inward linear motion of the plunger 114 is transferred to rotational motion of the rotary latch 118 causing the protrusion 144 to disengage from the notch 136 as rotary latch 118 rotates away from the notch 136. In one exemplary embodiment, FIGS. 6*a*-6*d* depict the configuration of the rotary latch 118 and the plunger 114 which allows for linear motion of the plunger 114 to transfer to rotational motion of the rotary latch 118. The plunger 114 includes a recess 137 for accommodating the rotary latch 118. The guide 140 couples the plunger 114 to the rotary latch 118. Because the rotary latch 118 is pivotally coupled to the chassis 106 by way of the post 119 and opening 130 (see FIG. 1), linear movement of the plunger 114 results in pivotal or rotary movement of the rotary latch 118.

Referring to FIGS. 2*c*, 5*a*-5*c* and 6*a*-6*c*, once the protrusion 144 disengages from the notch 136, the spring loaded bolt 108 and plunger 114 are biased from the retracted position of FIG. 5*a* to the extended position of FIG. 2*a*. The operator may then use both hands to close the window. As the window closes, the tapered undersides 149, 151 of the bolt 108 and plunger 114 engage the striker. Upon engagement with the striker, both bolt 108 and plunger 114 retract inwardly towards the chassis 106, and extend upon clearing the striker, thus locking the window sash as the flat side 143 of the bolt 108 becomes lodged behind the striker.

The operator needs to interface only once with the latch 100 when operating the handle 104 to unlock the latch 100. Once the latch 100 is unlocked and the bolt 108 is retracted, the operator may release the handle 104 and may use both hands to open the window as the flat side 143 and leading edge 109 of the bolt 108 automatically clears the striker when in the retracted position and are held in the retracted position by the protrusion 144 being lodged in the notch 136 as shown in FIG. 5*c*. However, the leading edge 145 and tapered top side 147 of the plunger 114 engage the striker after the bolt 108 clears the striker to return both the bolt 108 and plunger 114 to the extended position (see FIG. 1) when the window is opened. Upon closing the window, the operator simply slides the window shut as the tapered underside 149 and leading edge 109 of the bolt 108 and the tapered underside 151 and leading edge 145 of the plunger 114 slide smoothly over the striker as the springs 110, 112, 116 are compressed. The flat side 143 of the bolt 108 moves behind the striker under the bias of the springs 110, 112, thereby locking the latch 100.

In FIGS. 7, 8*a*-8*c*, 9*a*-9*c*, and 10*a*-10*d*, another exemplary embodiment of a latch 200, similar to latch 100, is disclosed. The latch 200 may include a cover with a handle (not shown), a chassis 206, a striker (not shown), a bolt 208 biased towards an extended position symmetrically by bolt springs 210, 212. A rotary latch 218 is pivotally connected to the chassis 206 by the post 219 being received in the opening 230. The latch 200 may operate similar to the latch 100, with at least one primary exception. Instead of a third spring biasing the plunger 214 towards the extended position, the rotary latch 218 acts to bias the plunger 214 towards the extended position. The rotary latch 218 includes a flexible elongated extension 254 which may engage a lip 256 on the chassis 206. Upon engaging the lip 256, the flexible elongated extension 254 not only biases the rotary latch 218 towards the notch 236 on the bolt 208, but also biases the plunger 214 towards the extended position. The remaining components of the latch 200 illustrated in FIGS. 7-10*d* that are analogous to previously described elements of the latch 100 include a 200 series reference numeral as opposed to a 100 series reference numeral (e.g., the plunger 214 (FIGS. 7-10*d*) as opposed to the plunger 114 (FIGS. 1-6*d*).

While only certain embodiments have been set forth, alternatives and modifications will be apparent from the above description to those skilled in the art. These and other alternatives are considered equivalents and within the spirit and scope of this disclosure and the appended claims.

What is claimed is:

1. A latch, comprising:

a chassis defining a recess;

a bolt biased towards an extended position and slidably received by the recess, the bolt comprising a passage through which a plunger extends, the bolt further comprising a notch;

a cover mounted to the chassis, the cover comprising a handle coupled to the bolt for moving the bolt to a retracted position when the handle pivots away from the cover;

the plunger being biased towards an extended position and slidably received in the passage, the plunger comprising a guide;

a rotary latch pivotally connected to the chassis opposite the bolt and plunger from the handle so that the rotary latch is disposed between the chassis and both the plunger and bolt and so both the plunger and bolt are disposed between the handle and the rotary latch, the rotary latch also comprising a guide slot for accommodating the guide of the plunger, the rotary latch further comprising a protrusion that rotates towards and into the notch when the bolt is in the retracted position and the plunger is in the extended position;

the bolt is moved towards the retracted position when the handle is actuated, as the bolt is moved towards the retracted position, the plunger remains in the extended position and the bolt slides inwardly towards the chassis against a first spring bias and the protrusion of the rotary latch rotates and engages the notch in the bolt as the protrusion of the rotary latch rotates towards the notch, retaining the bolt in the retracted position; and to release the bolt to be movable to the extended position, the plunger is pressed inwardly towards the chassis against a second spring bias which causes the rotary latch to rotate and the protrusion of the rotary latch to disengage from the notch, thereby releasing the bolt and allowing the bolt to slide along the chassis under influence of the first spring bias.

2. The latch of claim 1, wherein the first spring bias comprises a pair of bolt springs and the chassis comprises pins for receiving the bolt springs.

3. The latch of claim 1, wherein the passage is centrally located on the bolt, the bolt comprising an interior recess for housing the plunger and the rotary latch, the notch being disposed in the interior recess.

4. The latch of claim 1, wherein the plunger is biased by a plunger spring.

5. The latch of claim 4, wherein the protrusion is biased towards the notch by the plunger spring and the plunger when the bolt is retracted and the plunger remains extended.

6. The latch of claim 5, wherein the plunger comprises a tapered distal end that causes the plunger to move through the passageway and towards the chassis when the plunger engages the striker.

7. The latch of claim 1, wherein linear movement of the plunger causes the protrusion of the rotary latch to rotate towards or away from the notch.

8. A latch, comprising:

a chassis defining a recess;

a bolt biased towards an extended position and slidably received by the recess, the bolt comprising a passage through which a plunger extends, the bolt further comprising a notch;

a cover mounted to the chassis, the cover comprising a handle coupled to the bolt for moving the bolt to a retracted position when the handle pivots away from the cover:

the plunger being biased towards an extended position and slidably received in the passage, the plunger comprising a guide;

a rotary latch rotatably and pivotally connected to the chassis so that the rotary latch is disposed between the chassis and both the plunger and bolt, and the rotary latch further comprising a guide slot for accommodating the guide of the plunger, the rotary latch further comprising a protrusion that is biased towards and rotates towards the notch when the plunger is moved towards the extended position;

when the bolt is moved towards the retracted position, the bolt slides inwardly towards the chassis against a first spring bias and the protrusion of the rotary latch rotates towards and engages the notch as the rotary latch is biased towards and rotates towards the notch, retaining the bolt in the retracted position;

when the bolt is released to be movable to the extended position, the plunger slides inwardly towards the chassis against a second spring bias which causes the protrusion to disengage from the notch as the rotary latch rotates away from the notch, thereby releasing the bolt and allowing the bolt to slide along the chassis under influence of the first spring bias; and wherein the rotary latch further comprises a flexible elongated extension which provides the second spring bias to bias the plunger towards the extended position and the protrusion towards the notch.

9. The latch of claim 1, wherein the handle comprises at least one arcuate gear and the bolt comprises at least one rack gear for enmeshing with the arcuate gear of the handle.

10. A latch, comprising:

a chassis defining a recess;

a bolt biased towards an extended position and slidably received by the recess, the bolt comprising a passage through which a plunger extends, the bolt further comprising a notch;

a cover mounted to the chassis, the cover comprising a handle coupled to the bolt for moving the bolt to a retracted position when the handle pivots away from the cover:

the plunger being biased towards an extended position and slidably received in the passage, the plunger comprising a guide;

a rotary latch pivotally and rotably connected to the chassis and comprising a guide slot for accommodating the guide of the plunger, the rotary latch further comprising a protrusion that is biased towards and rotates towards the notch when the plunger is moved towards the extended position;

when the bolt is moved towards the retracted position, the bolt slides inwardly towards the chassis against a first spring bias and the protrusion of the rotary latch rotates towards and engages the notch as the rotary latch is biased towards the notch, retaining the bolt in the retracted position;

when the bolt is released to be movable to the extended position, the plunger slides inwardly towards the chassis against a second spring bias which causes the protrusion to disengage from the notch as the rotary latch rotates away from the notch, thereby releasing the bolt and allowing the bolt to slide away from the chassis under influence of the first spring bias.

11. A latch, comprising:

a chassis defining a recess;

a bolt biased towards an extended position and slidably received by the recess, the bolt comprising a passage through which a plunger extends, the bolt further comprising a notch;

a cover mounted to the chassis, the cover comprising a handle coupled to the bolt for moving the bolt to a retracted position when the handle pivots away from the cover;

the plunger being biased towards an extended position and slidably received in the passage, the plunger comprising a guide;

a rotary latch pivotally connected to the chassis and comprising a guide slot for accommodating the guide of the plunger, the rotary latch further comprising a protrusion that is biased towards and rotates towards the notch as the plunger is moved towards the extended position;

when the bolt is moved towards the retracted position, the bolt slides inwardly towards the chassis against a first spring bias and the protrusion of the rotary latch rotates towards and engages the notch as the rotary latch is biased towards and rotates into the notch, retaining the bolt in the retracted position;

when the bolt is released to be movable to the extended position, the plunger slides inwardly towards the chassis against a second spring bias which causes the protrusion to disengage from the notch as the rotary latch rotates away from the notch thereby releasing the bolt and allowing the bolt to slide away from the chassis under influence of the first spring bias; and wherein the plunger further comprises a recess adapted to receive the rotary latch.

12. A method for operating a latch for a window sash, comprising:

providing the latch of claim 1;

biasing the bolt and the plunger towards the extended positions, respectively, unlocking the latch, wherein the bolt retracts from the extended position to the retracted position, and is held in the retracted position by engaging the protrusion on the rotary latch with the notch in the bolt such that the window sash can be opened, the rotary latch being pivotally connected to the chassis and biased towards the notch;

opening the window sash, wherein the plunger retracts and disengages the protrusion from the notch upon engaging a striker, when the plunger cooperates with a portion of the striker, releasing the bolt such that the bolt is movable to the extended position under influence of the first spring bias upon clearing the striker; and closing the window sash, wherein the bolt and the plunger move towards the retracted positions, respectively, upon engaging the portion of the striker, and then release to the respective extended positions upon clearing the portion striker, engaging the bolt and plunger with the striker, thus locking the latch.

13. The method of claim 12, wherein the bolt and the plunger are biased towards the extended position by at least one spring.

14. The method of claim 12, wherein the method further comprising pivoting the handle away from the cover to move the bolt to the retracted position, and pivoting the handle towards the cover to release the bolt to the extended position.

15. The method of claim 12, wherein the protrusion and the notch are engaged and disengaged by rotational motion of the rotary latch.

16. The latch of claim 1 wherein the bolt comprises guides and the chassis contains pins for receiving a first and a second spring to provide the first spring bias and the bolt is symmetrically biased towards the extended position by the first and the second springs.

17. The latch of claim 1, wherein the handle is pivoted away from the cover when the bolt is in the retracted position and is pivoted towards the cover when the bolt is in the extended position.

* * * * *